US006323783B1

(12) United States Patent
Lizzi et al.

(10) Patent No.: US 6,323,783 B1
(45) **Date of Patent: *Nov. 27, 2001**

(54) DEVICE WITH ALTERNATING STATUS MESSAGE DISPLAY CAPABILITY

(75) Inventors: Ronald S. Lizzi, West Hartford; Edward Daly, Jr., Bristol, both of CT (US)

(73) Assignee: Timex Group B.V. (NL)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/159,718

(22) Filed: Sep. 24, 1998

(51) Int. Cl.[7] ..... G08B 5/22

(52) U.S. Cl. ..... 340/825.44; 368/244; 368/288; 368/30; 368/71; 370/311; 370/313; 455/38.3; 455/38.4

(58) Field of Search ..... 340/825.44; 455/38.3, 455/38.4; 370/311, 313; 368/30, 71, 244, 288; 345/40, 25, 113

(56) References Cited

U.S. PATENT DOCUMENTS

| | | | | |
|---|---|---|---|---|
| 4,385,295 | | 5/1983 | Willard et al. | 340/825.44 |
| 4,412,217 | * | 10/1983 | Willard et al. | 340/825.44 |
| 4,786,902 | | 11/1988 | Davis et al. | 340/825.44 |
| 4,851,829 | * | 7/1989 | DeLuca et al. | 340/825.44 |
| 5,406,272 | * | 4/1995 | Jang | 340/825.44 |
| 5,774,061 | * | 6/1998 | Kudoh | 340/825.44 |

* cited by examiner

*Primary Examiner*—Michael Horabik
*Assistant Examiner*—William L Bangachon
(74) *Attorney, Agent, or Firm*—Carmody & Torrance LLP

(57) ABSTRACT

A device such as a watch, pager or combination pager/watch that can iteratively display status information messages for set predetermined periods of time at a predetermined location on the display. In normal operation, the device is displaying a variety of standard information. Upon the detection of a status condition, the device will alternately display the standard information and status information messages corresponding to the status condition to more effectively alert the user to the existence of the status condition.

11 Claims, 4 Drawing Sheets

DEVICE WITH ALTERNATING STATUS MESSAGE DISPLAY CAPABILITY

BACKGROUND OF THE INVENTION

The present invention relates generally to devices for generating and displaying time information and receiving transmitted coded messages, and in particular, to an improved displaying methodology for providing status information messages to a user.

Generally, devices for both generating and displaying time information and receiving transmitted coded messages (hereinafter "pager/watches") that display status information messages in response to a status condition are known in the art. For example, U.S. Pat. No. 4,412,217 describes a radio pager with a visible indicator for displaying the number of received pages. Similarly, the design patent art is replete with pager constructions that display icons representing various status conditions.

It can therefore be seen that the prior art has recognized the need to alert a user to various status conditions taking place within a pager or a combination pager/watch. For example, representative icons may be displayed when a message buffer is full, etc. However, the known display methodology is deficient in that it insufficiently alerts a user to the particular status condition. Exemplary is the pager that merely constantly displays a battery icon to indicate a low battery level or an icon indicating receipt of a new message. Such constant and continuous displays without interruption may go unnoticed by the user. Likewise, other pager/watch displays may sacrifice one important display message for another. For example, if there is only one designated area on the display for status information, priority of displaying the messages becomes a major problem.

Accordingly, a device, which may be a pager, a watch, or a combination pager/watch that more expeditiously and effectively alerts a user to a status condition is desired. Similarly, it is also desirable to alert the user to the status condition in a manner that minimally intrudes on the user's ability to instantaneously obtain other information from the display. Accordingly, it is desirable to provide such a device that overcomes the aforementioned deficiencies. The invention disclosed herein achieves the aforementioned and below mentioned objectives.

SUMMARY AND OBJECTS OF THE INVENTION

Generally speaking, and in accordance with the invention, a device, such as a pager, a watch or a combination pager/watch that can iteratively display status information messages for predetermined periods of time at a predetermined location on the display is provided. The device preferably generates and displays first information such as the day of the week and then cycles through a series of status conditions to determine if any status conditions are satisfied. The device would generate status information messages corresponding thereto. The device displays the first information at a predetermined location on the display, and then alternately displays the status information messages at the predetermined location on the display for selected predetermined periods of time and thereafter, redisplays the first information at the predetermined location on the display. The display is arranged such that when the first information is being displayed on the display, the status information messages are not being displayed on the display, and when the status information messages are being displayed on the display, the first information is not being displayed on the display. The multiple status information messages are alternately displayed on the display, all at the predetermined location on the display and preferably one at a time.

Also in accordance with the present invention, a method of displaying information on a display of the device is provided. In the preferred embodiment, the method comprises generating and displaying first information at a predetermined location on the display, determining whether a first status condition is satisfied such that it is necessary to display on the display a first status information message corresponding thereto, displaying at the predetermined location of the display for a predetermined period of time the first status information message, and redisplaying the first information at the predetermined location on the display. Again, additional status information messages are alternately displayable at the predetermined location of the display.

Accordingly, it is an object of the present invention to provide a device that receives transmitted coded signals and/or generates and displays time information and that includes an improved display methodology.

Another object of the present invention is to provide such a device that more effectively alerts a user to a plurality of status conditions.

Still another object of the present invention is to provide a watch, a pager and/or pager/watch that more expeditiously alerts a user to various status conditions.

Yet another object of the present invention is to expeditiously and effectively alert a user to status conditions without sacrificing access to other desirable displayed information.

Still other objects and advantages of the invention will in part be obvious from the specification.

The invention accordingly comprises the features of construction, combination of elements, arrangement of parts and sequence of steps which will be exemplified in the construction and methodology hereinafter set forth, and the scope of the invention will be indicated in the claims.

BRIEF DESCRIPTION OF THE DRAWINGS

For a fuller understanding of the invention, reference is made to the following description taken in connection with the accompanying drawings, in which.

DETAILED DESCRIPTION OF THE PREFERRED EMBODIMENTS

Figure 1:
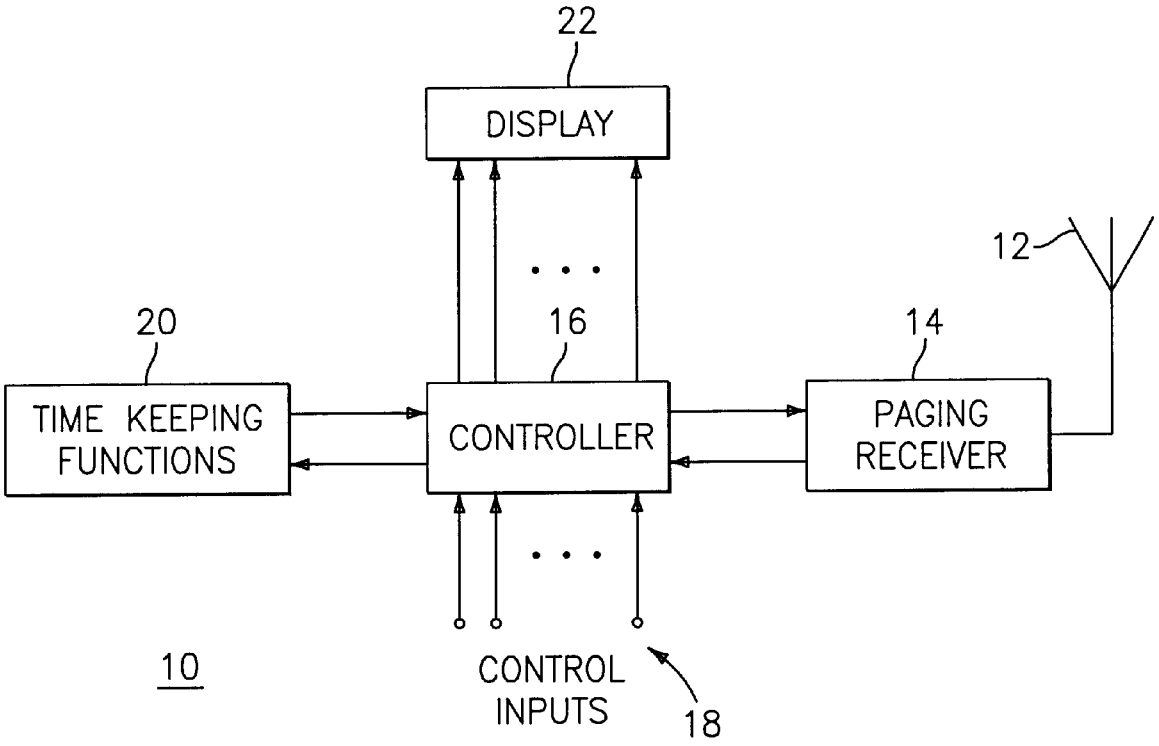
FIG. 1 is a simplified functional block diagram of a device constructed in accordance with the present invention.

Reference is first directed to FIG. 1, which represents a simplified functional block diagram for a device 10, preferably a pager/watch, constructed in accordance with the present invention. As should be understood, the present invention is applicable to a watch or other timepiece, a pager and/or a combination pager/watch. Hereinafter, for convenience, reference is made to a pager/watch although the claims will not be limited as such.

An electronic watch circuit 20, which is coupled to controller 16, provides time information such as time and day and date, normally displayed on a display 22. An antenna 12 is coupled to a paging receiver 14, which itself is coupled to controller 16. Paging receiver 14 receives transmitted coded message signals and displays the received message information on display 22. It will be appreciated by one skilled in the art that the time information being generated by watch circuit 20 may include other functions such as elapsed time, interval times, and an alarm. Control of watch circuit 20 and paging receiver 14 is provided by user control inputs 18, which are coupled to controller 16, and which may be device switches or buttons as would be well understood in the art.

In normal operation, the pager/watch arrangement of FIG. 1 may function like a watch with the present time displayed on display 22. The device switches provide control of the watch functions through controller 16. However, when transmitted coded message signals, or pages, are received and decoded by paging receiver 14 in a manner well known to one skilled in the art, a control signal is generated by paging receiver 14 causing the pager/watch arrangement to function as a display pager. This may be effected by changing both the information displayed and the normal functions of the device switches. Thus, after the page has been received, the display may indicate a message was received as discussed below. Paging receiver 14 will include memory for storage of the message information. Readout of the message information stored in the memory is then controllable by the same device switches normally used to control the watch functions.

Figure 2:
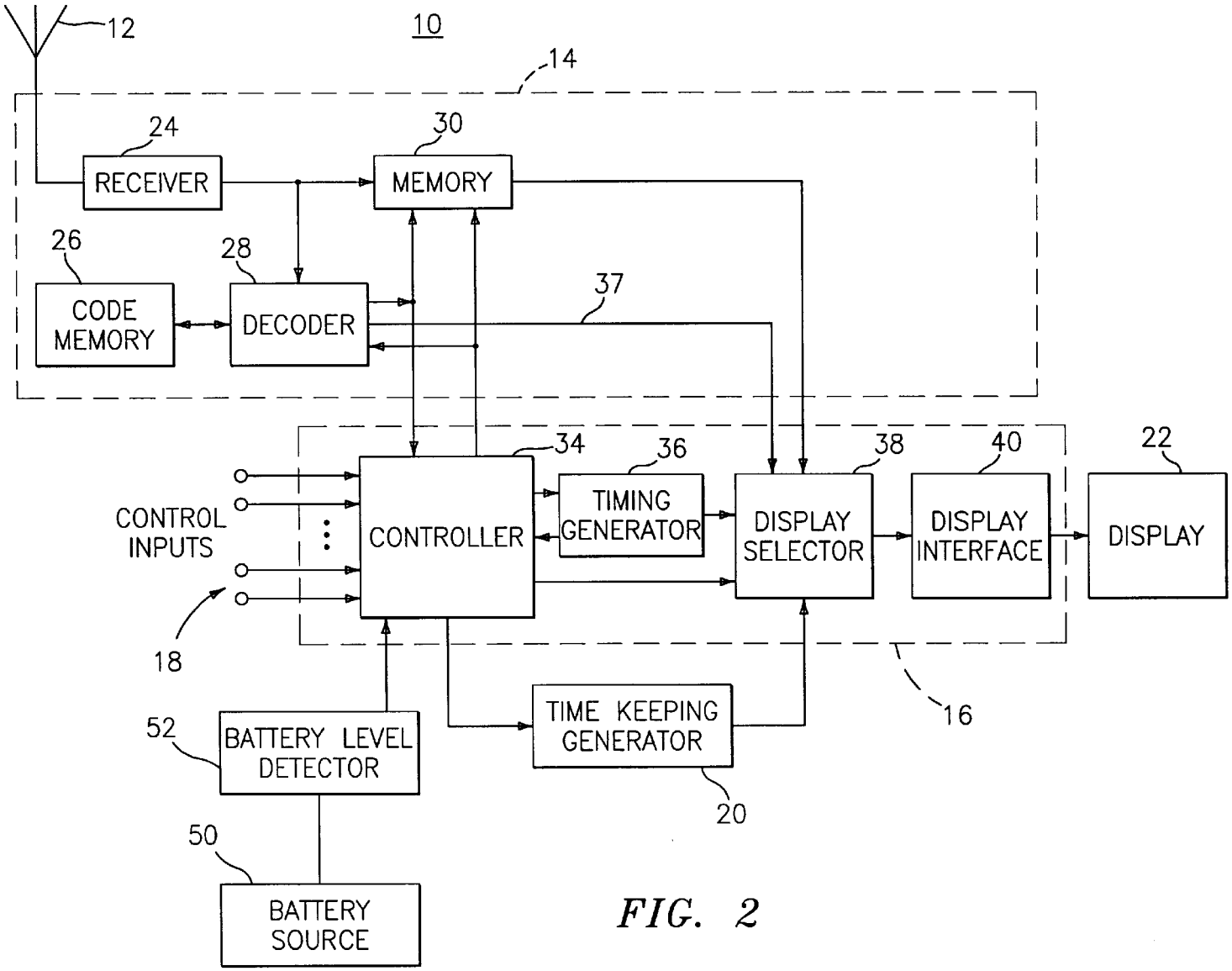
FIG. 2 is a functional block diagram of the device of FIG. 1 illustrating the details of the functional blocks shown in FIG. 1.

Reference is next directed to FIG. 2 which shows a more detailed block diagram of the present invention. Controller 16 is shown to consist of a controller 34 used for steering control inputs 18 to either time keeping circuit 20 or paging receiver 14. Implementations for watch circuit 20 and paging receiver 14 are separately well known to those skilled in the art, and will therefore be omitted for brevity. Outputs from watch circuit 20 and paging receiver 14 provide time and message information, respectively, to display selector 38. Display selector 38 is coupled to controller 34 and selects time or message information for display depending upon which section of the watch/pager device is being controlled by controller 34. The information selected by display selector 38 is provided to a display interface 40 circuit which drives display 22.

Paging receiver 14 consists of antenna 12 coupled to a receiver circuit 24. Receiving circuit 24 receives the transmitted coded message signals which normally consists of transmitted selective call signaling information and transmitted message information in a manner well known in the art. The transmitted coded message signals are demodulated in receiving circuit 24, again in a manner well known to one skilled in the art, and provided at the output thereof as a stream of binary information representing demodulated coded message signals consisting of selective call signaling information and message information. The output of receiving circuit 24 is coupled to a decoder 28. Decoder 28 has a second input from a code memory 26 which stores predetermined address information consisting of one or more addresses to which paging receiver 14 will respond, as would be understood by one skilled in the art. Memory 30 for storing message information, is capable of storing multiple messages received at different times and is coupled to receiving circuit 24, decoder 28, controller 34 and display selector 38 as would be understood in the art. Decoder 28 may also transmit a control signal to controller 34 to effect control of paging receiver 14 by the device switches.

A timing generator circuit 36 is coupled to both controller 34 and selector 38. Timing generator 36 controls the time duration during which received message information or status information is displayed on display 22. For example, when controller 34 selects paging receiver 14, a predetermined display time interval is generated. Upon completion of the time interval, timing generator 36 generates an output to cause controller 34 to again select the watch functions. In the preferred embodiment of the present invention, timing generator 36 also controls the duration for which the various status information messages are displayed on display 22, while controller 34 controls the checking of the status conditions and generation of the status information messages as will be better understood below.

Other control functions are known in the art and described in U.S. Pat. No. 4,786,902, by way of example. Methods for storing and displaying the received unread messages is also well understood in the art and described in U.S. Pat. No. 4,385,295, by way of example.

A battery source 50 is also provided and may be in the form of a button type energy cell in the watch/pager case. A battery level detector 52 detects the battery level of battery source 50 and provides the battery level status to controller 34.

Figure 3:
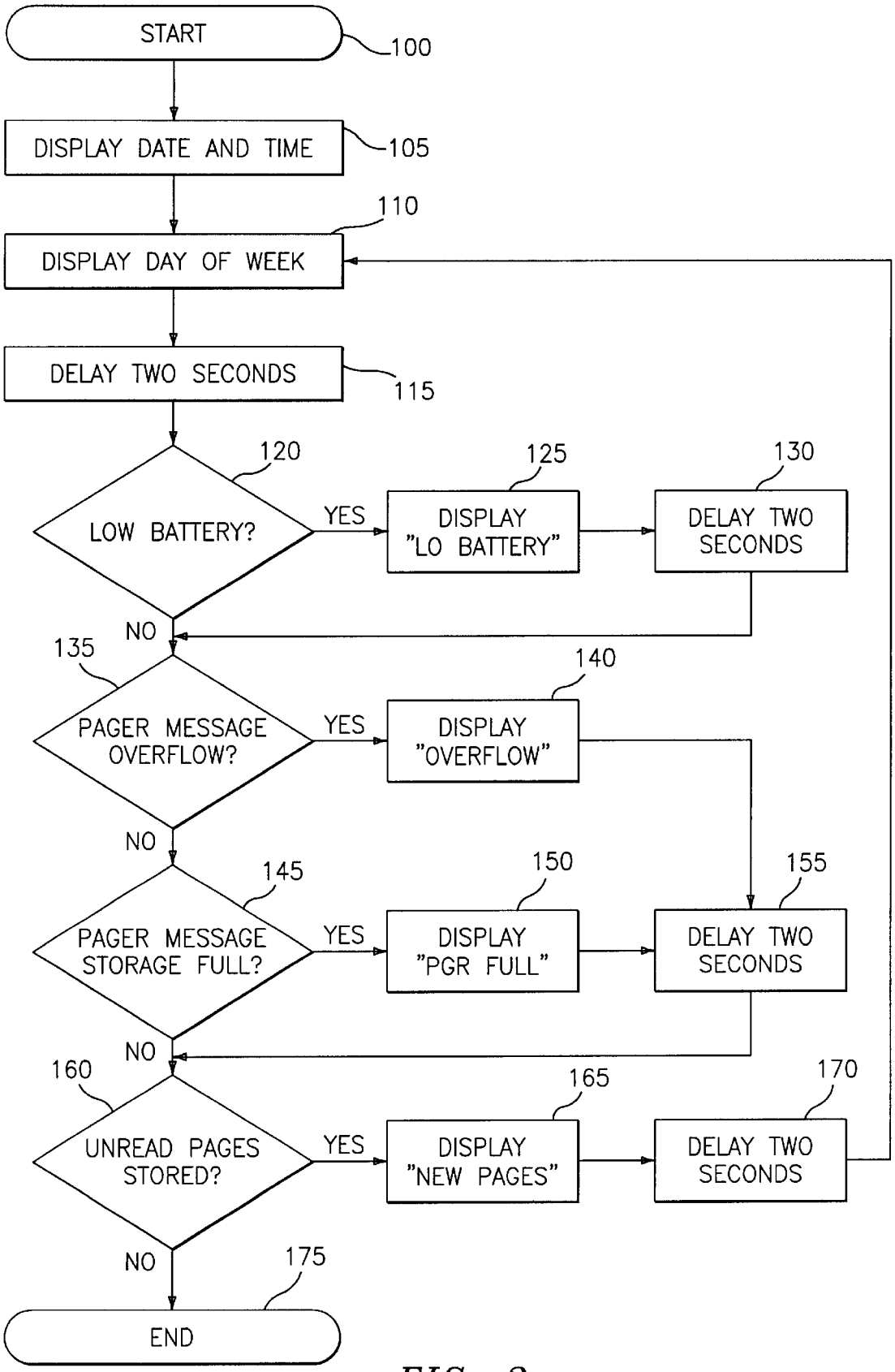
FIG. 3 is a flowchart illustrating the operation of the device in accordance with the present invention.

Reference is now made to FIGS. 3 and 4 which should be taken in connection with the following description for a further understanding of the present invention.

Figure 4A:
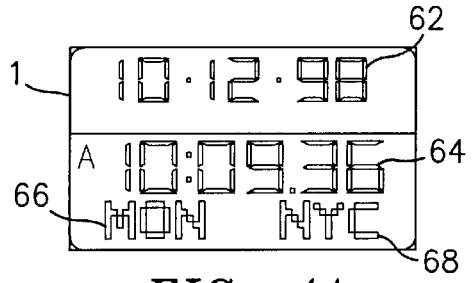
FIGS. 4A–4E illustrate exemplary displays of a device constructed in accordance with the present invention.

In the exemplary and preferred embodiment, pager/watch is generally displaying the time-of-day mode similar to that illustrated in FIG. 4A. In the time-of-day mode of FIG. 4A, pager/watch 10 may display the date 62, the time 64, and the day of week 66 along with an exemplary time zone 68 notation NYC (New York City) indicating Eastern Standard Time. These steps are indicated as steps 100, 105 and 110 in FIG. 3.

As will now be fully appreciated, the following methodology permits for the continuous sequencing through of a plurality of status conditions and the continuous sequencing of corresponding status information messages. If any of the status conditions are met, such as the battery level is low, there is pager message overflow, or there are unread pages stored, the corresponding status information messages are iteratively and temporarily displayed on the display until the user takes the corresponding appropriate action, such as changing the battery or reading unread messages.

Generally speaking, the flowchart and subroutine in FIG. 3 illustrates that various status conditions are checked to determine whether or not such respective status information messages should be displayed. Advantageously, the sequencing of the displayed status information messages more readily attracts the attention of the user by virtue of the changing nature of the display.

Figure 4B:
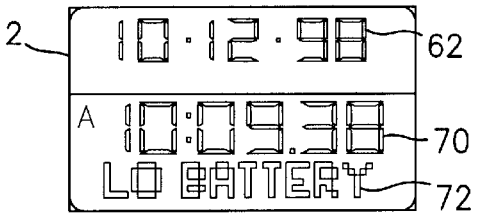
Figure 4C:
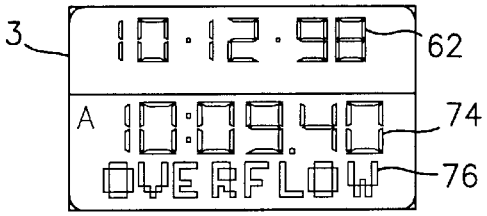

For example, after a predetermined amount of time, in the preferred embodiment the period of time being two (2) seconds (step 115), the battery level is checked (step 120). If the battery level is low, a "LO BATTERY" message 72 is displayed (step 125) where the day 66 and time zone 68 was previously displayed (FIG. 4B). The passage of the two second delay can be seen in time 70. After another delay of two seconds (step 130) the controller checks whether there is, for example, a pager message overflow (step 135). In the exemplary display of FIG. 4C, it is illustrated that there is a message overflow and therefore there is a display of the phrase "OVERFLOW" 76 which is indicated in step 140 of FIG. 3. Again time 74 has incremented two seconds. The "OVERFLOW" display 76 is displayed for the preferred two seconds (step 155) until which there is a determination as to whether there are any unread pages currently stored (step 160). If there are unread pages stored, a phrase "NEW PAGES" 84 is displayed (step 165) as illustrated in FIG. 4E, this display being viewable for essentially two seconds (step 170 and note time 82) until which the display returns to that as illustrated in FIG. 4A (step 110) wherein the day of the week 66 and/or time zone 68 is displayed.

Figure 4D:
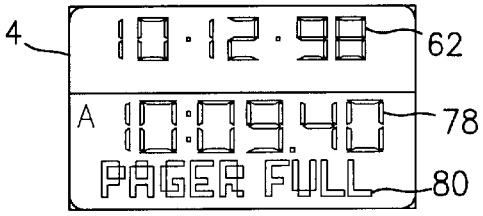
Figure 4E:
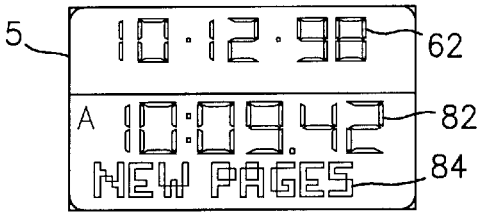

In the routine just described, FIG. 4D was intentionally omitted as it illustrates the exemplary display when there is no pager message overflow but rather when the pager message storage is full (step 145). If the pager message storage is full, pager/watch 10 will display a phrase "PAGER FULL" 80 as indicated in step 150 of FIG. 3. "PAGER FULL" will be displayed for two seconds (step 155) at which point the routine continues as described above to step 160.

It can therefore be seen that the present invention provides a new and advantageous method of providing information to a user in an expeditious and effective manner, while maintaining the user's ability to concurrently receive other information such as the time of day and date.

It should also be understood that such status information messages are by way of example and should not be interpreted in a limiting sense, and that other contemplated status information to which the skilled artisan may want to alert the user can be displayed. It should also be understood that the two second display of each status information message is by way of example and not by limitation since other delays, such as 1 second or 3 seconds are one of design choice, the only essential feature being that there is an alternating pattern to the display so as to facilitate a user's awareness to the status information messages. Additionally, it is contemplated that the length of the delays may be variable depending on the status information message being displayed. It will also be understood that the two second delay may not be exact but is essentially two seconds. Lastly, it is up to the skilled artisan as to where on the display the alternating status information is displayed. Lastly, the number of messages displayable is one of design choice left to the skill of the artisan.

It will thus be seen that the objects set forth above, among those made apparent from the preceding description, are efficiently attained and, since certain changes may be made in the above constructions or methodology without departing from the spirit and scope of the invention, it is intended that all matter contained in the above description or shown in the accompanying drawings shall be interpreted as illustrative and not in a limiting sense.

What is claimed is:

1. A device for at least one of generating and displaying time information and receiving transmitted coded message signals, the device comprising:

means for generating time information indicative of the time of day;

a status information message means for:

(a) determining if a first status condition is satisfied and generating a first status information message corresponding thereto; and (b) determining if a second status condition is satisfied and generating a second status information message corresponding thereto;

a display for:

(a) continuously displaying the time information at a first predetermined location on the display even when a status information message is being displayed; and (b) for displaying the first status information message at a second predetermined location, different from the first predetermined location, when the first status condition is satisfied, and thereafter, for displaying the second status information message at the second predetermined location when the second status condition is satisfied, and thereafter, for continually and iteratively redisplaying at least the first status information message and the second status information message at the second predetermined location on the display when the respective first and second status conditions are still satisfied;

wherein the display of at least the first status information message and the second status information message are continually alternately displayed at the second predetermined location on the display; and wherein when the first status information message is being displayed on the display the second status information message is not being displayed on the display, and when the second status information message is being displayed on the display the first status information message is not being displayed on the display.

2. The device as claimed in claim 1, wherein the status information message means determines if at least a third status condition is satisfied and generates at least a third status information message corresponding thereto;

and prior to redisplaying the first status information message, the display displays at the second predetermined location of the display at least the third status information message when the third status condition is satisfied, and thereafter, redisplays at least the first status information at the second predetermined location on the display;

wherein only one status information message is being displayed at a time at the second predetermined location when the respective status conditions are satisfied;

wherein when the first status information message is being displayed on the display neither the second nor third status information message is being displayed on the display, and when the second status information message is being displayed on the display neither the first nor third status information message is being displayed on the display, and when the third status information message is being displayed on the display neither the first nor second status information message is being displayed on the display.

3. A method of displaying information on a display of a device that is at least capable of one of generating and displaying time information and receiving transmitted coded message signals, the method comprising:

(a) generating and continuously displaying time information indicative of the time of day at a first predetermined location on the display;

(b) determining whether a first status condition is satisfied such that it is necessary to display on the display a first status information message corresponding thereto and displaying on the display the first status information message, at a second predetermined location different from the first predetermined location;

(c) determining whether a second status condition is satisfied such that it is necessary to display on the display a second status information message corresponding thereto and displaying on the display the second status information message, at the second predetermined location;

(d) continually and iteratively redisplaying at least the first status information message and the second status information message at the second predetermined location of the display if the respective first and second status conditions are still satisfied;

wherein the display of at least the first status information message and the second status information message are continually alternately displayed at the second predetermined location on the display;

wherein when the first status information message is being displayed on the display the second status information message is not being displayed on the display, and when the second status information message is being displayed on the display the first status information message is not being displayed on the display; and even when the first or second status information messages are being displayed at the second predetermined location, the time information is being continually displayed at the first predetermined location.

4. The method as claimed in claim 3, including the steps of:

determining if at least a third status condition is satisfied and generating at least a third status information message corresponding thereto; and displaying, after displaying the second status information message and prior to redisplaying at least the first status information message, in the second predetermined location of the display, at least the third status information message corresponding to the third status condition when the third status condition is satisfied;

whereby only one status information message is being displayed at a time at the second predetermined location on the display.

5. A device for at least one of generating and displaying time information and receiving transmitted coded message signals, the device comprising;

an information generator for generating time information indicative of the time of day;

a status information message generator for determing if a first status condition is satisfied and generating a first status information message corresponding thereto; and a display for (a) continuously displaying the time information at a first predetermined location on the display even when a status information message is being displayed; and (b) for temporarily and iteratively displaying at least the first status information message at a second predetermined location, different from the first predetermined location, when the first status condition is satisfied.

6. The device as claimed in claim 5, wherein the display is configured to display additional information at the second predetermined location;

wherein (i) the additional information is continuously displayed at the second predetermined location when the first status condition is not satisfied;

(ii) when the first status information message is being displayed at the second predetermined position on the display, the additional information is not being displayed on the display; and (iii) when the additional information is being displayed at the second predetermined position on the display, the first status information message is not being displayed on the display;

such that when the first status information message is satisfied, there is a repeated and alternating display of at least the additional information and the first status information message at the second predetermined location.

7. The device as claimed in claim 6, wherein the additional information comprises one or more of date information, day of the week information and time zone information.

8. The device as claimed in claim 5, wherein the first status information message is a text message.

9. A method of displaying information on a display of a device that is at least capable of one of generating and displaying time information and receiving transmitted coded message signals, the method comprising:

(a) generating and continuously displaying time information indicative of the time of day at a first predetermined location on the display;

(b) determinging whether a first status condition is satisfied such that it is necessary to display on the display a first status information message corresponding thereto and temporarily and iteratively displaying on the display at least the first status information message at a second predetermined location different from the first predetermined location.

10. The method as claimed in claim 9, wherein the display is configured to display additional information at the second predetermined location, wherein the method comrpises the further steps of ;

displaying continuously the additional information at the second predetermined location when the first status condition is not satisfied; and at a second predetermined position, when the first status condition is satisfied, iteratively and continuously displaying at least the first status information message and the additional infomration.

11. The method as claimed in claim 10, wherein the display is configured to display additional information at the second predetermined location, wherein the method comprises the further steps of:

determing if at least a second status condition is satisfied and generating at least a second status information message corresponding thereto; and displaying, after displaying the first status information message and prior to redisplaying the additional information in the second predetermined location of the display, at least the second status information message when the second status condition is satisfied;

whereby only one status information message is being displayed at a time at the second predetermined location on the display and whereby the additional information and a status information do not appear simultaneously on the display at the second predetermined location.

* * * * *